United States Patent [19]

Schaltegger

[11] Patent Number: 4,657,054

[45] **Date of Patent: *Apr. 14, 1987**

[54] METHOD AND APPARATUS FOR HIGH SPEED CONTAINER PLACEMENT

[76] Inventor: Herbert E. Schaltegger, 10 Schaghticoke Trail, New Milford, Conn. 06776

[21] Appl. No.: 893,035

[*] Notice: The portion of the term of this patent subsequent to Dec. 2, 2003, has been disclaimed.

[22] Filed: Aug. 1, 1986

Related U.S. Application Data

[63] Continuation-in-part of Ser. No. 716,680, Mar. 27, 1985, Pat. No. 4,625,775.

[51] Int. Cl.[4] ..... B65B 1/04

[52] U.S. Cl. ..... 141/1; 141/83; 141/167; 141/168; 141/170; 74/393; 198/504; 198/474.1; 198/343

[58] Field of Search ..... 198/504, 505, 474.1, 198/475.1, 343; 74/393; 141/129–191, 83, 98, 1–12

[56] References Cited

U.S. PATENT DOCUMENTS

| | | | |
|---|---|---|---|
| 2,860,760 | 11/1958 | Yeo et al. | 198/24 |
| 2,931,276 | 4/1960 | Zerlin | 198/474.1 |
| 3,978,968 | 9/1976 | Rose et al. | 198/339 |
| 4,168,773 | 9/1979 | Thiel et al. | 198/479 |
| 4,275,807 | 6/1981 | Mohn et al. | 198/474.1 |
| 4,450,950 | 5/1984 | Foote, Jr. | 198/474.1 |
| 4,456,114 | 6/1984 | Mohn | 198/474.1 |
| 4,514,953 | 5/1985 | Patzwahl | 141/167 |

*Primary Examiner*—Houston S. Bell, Jr.
*Attorney, Agent, or Firm*—Edward D. C. Bartlett

[57] ABSTRACT

High speed container placement method and apparatus are provided for use in combination with high speed filling equipment for consumer products, such as instant coffee. A container separating device introduces groups of containers to a container placement and removal device for sequencing therethrough. The individual members of a group are transferred from a high speed annular turntable of the container placement and removal device to separate stationary work positions on a deck plate where they undergo a processing step such as filling the container by weight with an appropriate amount of product. Following this processing step, the containers are removed from their respective stationary work positions and returned to the high speed annular turntable to be ultimately discharged from the container placement and removal device. Simultaneously, the next group of containers is being fed into the apparatus to sequentially replace the fully processed group. The containers are placed at and removed from the work positions respectively by feed and discharge guides which oscillate as they travel about the deck plate in an epicycloidal path.

30 Claims, 35 Drawing Figures

METHOD AND APPARATUS FOR HIGH SPEED CONTAINER PLACEMENT

CROSS REFERENCE TO RELATED APPLICATION

This is a continuation-in-part of application Ser. No. 716,680 filed Mar. 27, 1985, now U.S. Pat. No. 4,625,775.

FIELD OF THE INVENTION

The present invention relates to methods and apparatus for high speed container placement. It is particularly applicable to filling operations to achieve net weight filling of product into containers being processed at high line speeds.

BACKGROUND OF THE INVENTION

Various government regulations require that the average actual net weight of packaged or containerized consumer products, such as instant coffee, be equal to or above the labelled net weight of the products. To keep abreast of the demand for their products, manufacturers must utilize high speed filling machines which move the containers at constant speeds. Since only volumetric dispensing devices can be used to fill moving containers, and the labelled net weight must be close to the actual net weight even when the dispensed volume or the product density are at their lowest levels, manufacturers often overfill containers with considerable amounts of product as fluctuations in the density of the product and the dispensing volumes occur.

To eliminate such inaccuracies, it is desirable that the product be dispensed by weight into the container; however, accurate weighing requires a low rate of product flow which, in turn, requires long filling cycles. Ideally, to keep the length of filling time to a minimum, the containers may be first underfilled with the bulk of a product from a volumetric filling machine. Thereafter, these underfilled containers may be topped off with a small amount of product to bring the actual net weight to the labelled net weight in fairly short time cycle, e.g., under two seconds, utilizing low product flow in a machine dispensing by weight.

Since known weight dispensing devices cannot travel at high speeds and maintain their accuracy utilizing desirable low product flow rate, it has become necessary to perform the top-off dispensing operation from stationary dispensing devices. This permits an unimpeded flow of product into the stationary dispensing device as well as accurate weight control. With the containers travelling at a desired line speed, the containers must be decelerated to a stop underneath the dispensing device for the period of time necessary for the filling operation to be performed at a low rate of product flow, and then accelerated to restore them to their normal rate of line speed.

Conventional means employed to perform these deceleration/acceleration steps utilizes a reciprocating fork mechanism to decelerate the containers to rest under stationary dispensing devices, and then accelerate them back to line speed, the containers travelling in a straight line during the decelerating and accelerating. However, these mechanisms are incapable of operating in connection with high line speeds, even if they handle several containers simultaneously, since the mechanisms are large, bulky and required several time-consuming movements for proper positioning and removal of the containers in relation to the dispensing devices.

SUMMARY OF THE INVENTION

It is an object of the present invention to provide an improved method of high speed container placement, particularly in conjunction with filling of the containers.

It is also an object of the present invention to provide an improved container placement device for use with high speed production lines.

A feature of the invention is transferring the containers between a conveyor, for example a turntable, and stationary container receiving stations along epicycloidal type curved paths. This has the advantage of enabling the containers to be transferred from high line speeds to rest for processing and then the processed containers transferred from rest back to the high line speed, this being accomplished with smooth deceleration and acceleration, respectively, of the containers and with an adequate dwell time of the containers at the stationary receiving stations for processing.

Another feature of preferred embodiments of the invention is decelerating and accelerating, respectively, the containers to and from rest along curved paths with graduated deceleration and acceleration, respectively. The rate of both deceleration and acceleration preferably smoothly increasing from zero to a maximum value and then smoothly decreasing back to zero. This has the advantage of reducing shock to the containers during the transferring movements and enabling placement of the containers while being conveyed at high line speeds.

Accordingly, therefore, there is provided by one aspect of the present invention a method of high speed placement of containers, comprising the steps of introducing a container into a circular path at a first speed, transporting the container along the circular path at this first speed, and transferring the container along an epicycloidal path to a stationary rest position. The container is maintained in the rest position for a rest period, processed during the rest period, and then transferred along the the epicycloidal path from the rest position to the circular path. Then the container is moved along the circular path at the first speed, and removed from the circular path at the first speed.

Advantageously, the processing step may comprise dispensing contents by weight into the container while stationary.

Instead of containers, this method could be employed with other workpieces upon which it was desired to perform some operation, e.g. labelling, while they were at rest.

According to another aspect of the present invention there is provided a method of high speed placement of containers, comprising the steps of moving a container along a selected path at a production line speed, intercepting the container, and decelerating the intercepted container to rest, the intercepted container being moved along a first curved path during this decelerating step and being transferred thereby to a stationary container receiving station. The container is processed while at rest at the container receiving station, and then returned to the selected path, the processed container being accelerated along a second curved path during the returning step. Then the container is continued along the selected path at the production line speed.

The container may be partially pre-filled with contents before the intercepting step. The processing step may comprise dispensing by weight further contents to fill the container to a predetermined net weight. The partially pre-filling step may comprise dispensing the contents by volume, and the processing step may include weighing.

A portion of the deceleration and acceleration along intermediate portions of the curved paths is preferably at a higher rate than along beginning and end portions of these curved paths.

The first and second curved paths preferably comprise portions of a curve generated by a point on the circumference of a circle rolling on a base path. The base path is preferably a circle, but other base paths could be employed to provide portions of epicycloidal type curves for the first and second curved paths. An advantage of these types of curves is that they can be generated by rotary motion which facilitates and simplifies high speed operation.

According to yet another aspect of the invention, there is provided a high speed container placement apparatus, comprising a plurality of stationary container receiving stations disposed about a central axis, a conveyor movable around this axis, and guiding means for guiding and transferring containers between the conveyor and the container receiving stations. The guiding means comprises feeder and discharge guide members for moving the containers respectively to and from the receiving station. Means is provided for moving each of the guide members around the axis and for causing each of the guide members to define an epicycloidal type path, the guide members moving the containers to and from the receiving stations along portions of the epicycloidal type path.

Means may be provided for moving the conveyor around the axis. Also, means is preferably provided for interrelating the conveyor moving means and the guide members moving means to cause the conveyor to move around the axis faster than the guide members move around the axis.

Preferably, means is provided for oscillating the guide members as the guide members move around the central axis. Each of the guide members is preferably pivotally mounted eccentrically on a rotatable gear. Advantageously, the gear may form part of gearing through which movement of the conveyor and movement of at least one of the guide members around the central axis are interrelated.

Other objects, features and advantages of the present invention will become more fully apparent from the following detailed description of the preferred embodiment, the appended claims and the accompanying drawings.

DETAILED DESCRIPTION OF THE PREFERRED EMBODIMENTS

Figure 1:
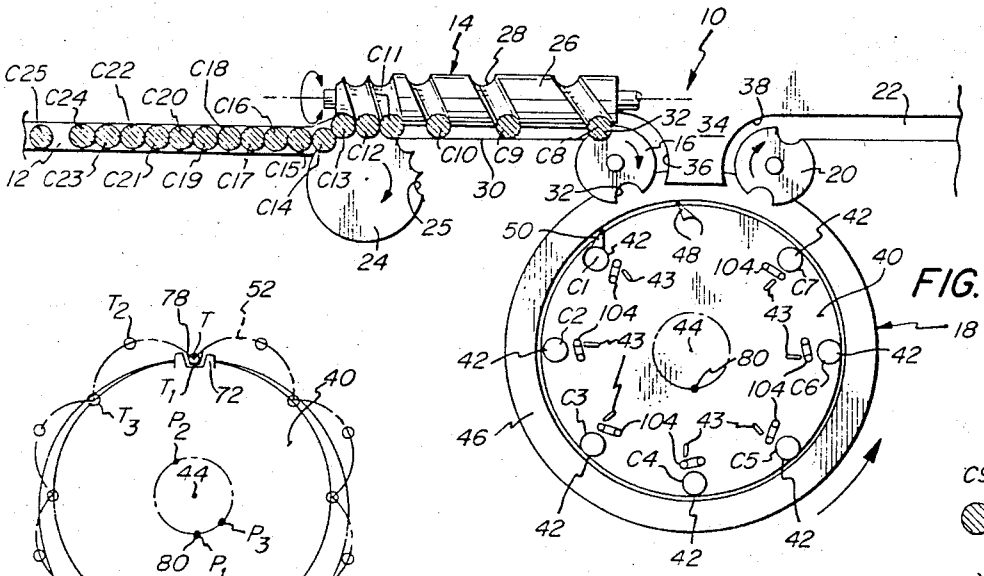
FIG. 1 is a schematic top elevational view of a container placement apparatus embodying the present invention.

Turning first to FIG. 1 of the drawings, therein illustrated is a high speed container placement apparatus embodying the present invention and generally indicated by the numeral 10. The apparatus 10 comprises a delivery conveyor 12, a container separating device generally indicated by the numeral 14, a rotatably driven supply starwheel 16, a container placement device generally indicated by numeral 18, a rotatably driven exit starwheel 20, and an exit conveyor 22.

The container apparatus 10 shown in FIG. 1 is in operating sequence with a plurality of containers C1 to C25 being sequenced therethrough. Throughout the specification and drawings, the containers will be designated by the letter C; however, designations for specific containers will also include a reference numeral, for example, container C1, etc. While being sequenced through the apparatus 10, the containers undergo processing or filling; containers which have not undergone processing are illustrated with cross hatched lines.

The delivery conveyor 12, which is of conventional belt or roller driven design, is generally flooded with containers awaiting processing through the container placement device 18. Adjacent the terminal end of the conveyor 12 is the container separating device 14, which permits release of seven containers in succession from conveyor 12 by means of a separating disc 24 rotatably driven in the clockwise direction and having seven cut-outs 25 along a portion of its outer periphery. for engaging and separating the groups of seven containers. Each group is propelled by the separating disc 24 to a timing screw 26 rotatably driven to space or separate the containers from one another by a desired distance for purposes to be explained hereinafter.

The timing screw 26 is provided with a continuous helical groove 28 along the outer periphery thereof. The pitch of the groove 28 increases along the axial length of the timing screw 26 whereby rotation of the timing screw 26 will separate the individual members of the group of containers to achieve the desired spacing thereof. It is preferred that the timing screw 26 operate in conjunction with a retaining wall 30 which extends parallel to the longitudinal axis of the timing screw 26 and maintains the containers in the groove 28 therein.

Juxtaposed adjacent the righthand end portion of the timing screw 26 is the supply starwheel 16 rotatably driven in the clockwise direction and having a pair of diametrically opposed cut-outs 32 for receiving containers from the separating device 14 and transferring them to the container placement device 18. The starwheel 16 cooperates with a deflector 34 having opposed concave surfaces 36 and 38 to guide the containers in an arcuate path along the deflector 34. The operation of the starwheel 16 and the other portions of container separating device 14 is controlled by conventional means, such as appropriate gearing.

The container placement device 18 is provided with a stationary disc-shaped deck plate 40 having eight positions spaced concentrically around a central axis 44. Seven of these positions are provided with container receiving or weight stations 42, each spaced a uniform distance from a central axis 44 and shown in FIG. 1 as having one of the containers C1 to C7 thereon. It should be noted that the deck plate position on deck plate 40 located between the starwheels 16 and 20 does not have a container receiving station 42 associated therewith. In the preferred embodiment, each of the receiving stations 42 has a dispensing device 43 (see FIGS. 1, 21 and 22) mounted thereabove for purposes to be explained further hereinafter.

Mounted concentrically about the deck plate 40 is an annular turntable 46 which is rotatable in the counterclockwise direction about the central axis 44. Mounted for oscillation over the deck plate 40 are feeder guide 48 and discharge guide 50. These guides 48, 50 oscillate as they travel about the deck plate 40 in an epicycloidal path 52 shown in FIG. 2 for purposes and in a manner to be explained further hereinafter.

The rotatably driven exit starwheel 20 is positioned adjacent the annular turntable 46 to intercept containers thereon and move them along arcuate surface 38 to the exit conveyor 22. The exit conveyor 22 is of conventional belt or roller driven design similar to the delivery conveyor 12, and moves the containers away from the container placement device 18 for further packaging or processing.

Figure 21:
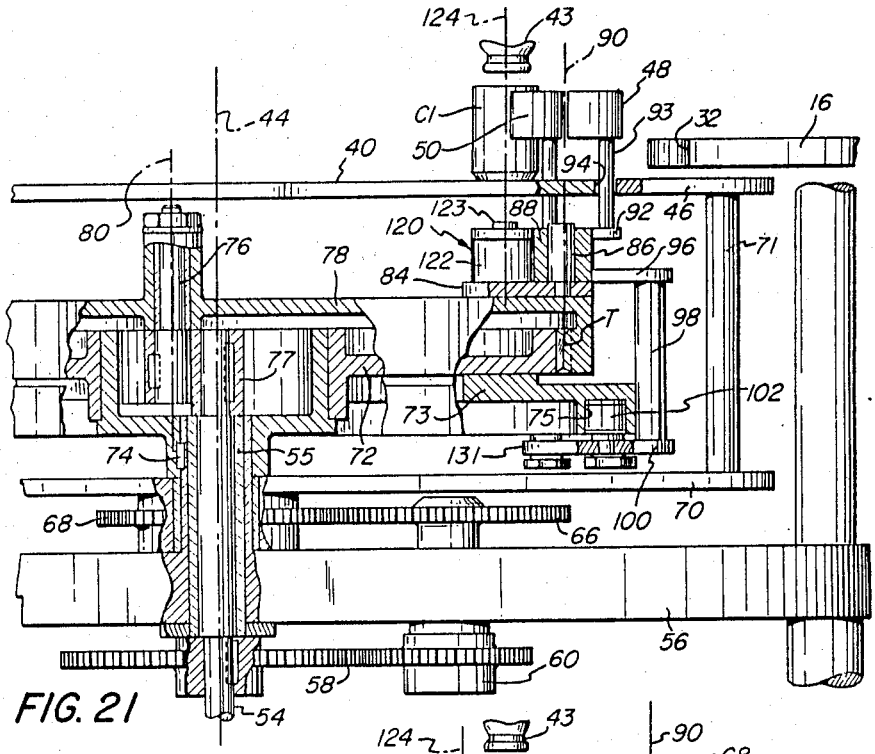
FIGS. 21 and 22 are fragmentary side elevational views of the apparatus of FIG. 1 showing the operating mechanism in its two extreme positions and having portions removed and broken away for purposes of illustration.
Figure 22:
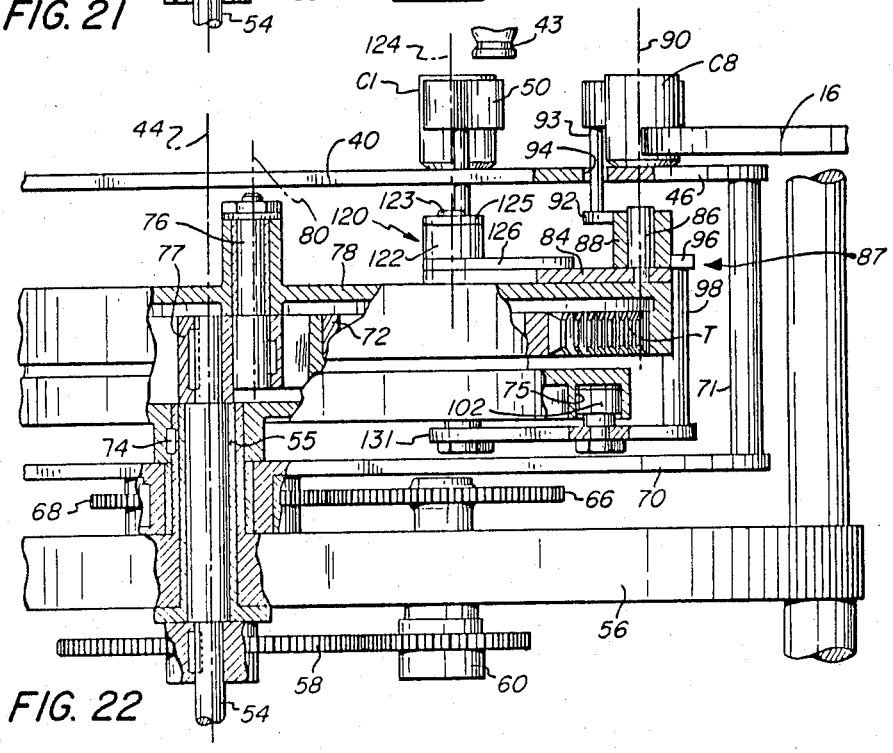

Turning now to FIGS. 21 and 22, the operating mechanism for oscillating and rotating the feeder and discharge guides can be more clearly understood. A main drive shaft 54 is journalled in a bearing 55 through a stationary machine frame 56 for rotation about the central axis 44 and is connected to a source of rotary power (not shown). Fixed to the drive shaft 54 is a gear 58 which meshes with a transfer gear 60. The gear 60 is operatively connected to an idler gear 66 on the upper side of the machine frame 56. The gear 66 meshes with a gear 68 secured to a drive plate 70. The drive plate 70 includes a multiplicity of column rods 71 (only one shown) extending upwardly at the outer periphery thereof. The column rods 71 support the annular turntable 46 at the upper ends thereof whereby rotation of the drive shaft 54 operates the gear train (gears 58, 60, 66 and 68) to rotate the drive plate 70 and ultimately the annular turntable 46 through the column rods 71 at a desired angular speed.

The main drive shaft 54, and the bearing 55 within which it is journalled, are disposed partially in and extend upwardly through central apertures within gear 68, plate 70 and a stationary gear 72. The stationary gear 72 is fixed to bearing 55 by key 74. The underside of the stationary gear 72 has an annular extension 73 which defines a circular cam track 75 spaced outwardly from the outer edge of the stationary gear 72. The terminal end of the drive shaft 54 has a bracket 77 thereon including an eccentrically located shaft 76.

An internal gear 78 is rotatably mounted on the shaft 76 for rotatable movement about shaft axis or center 80. The internal toothed portion of internal gear 78 is in meshing engagement with the stationary gear 72 (note tooth T in FIG. 21) so that any tooth on the internal gear 78 describes an epicycloidal path, such as path 52 depicted in FIG. 2, when the center axis 80 of the internal gear 78 is rotated around the central axis 44.

Figure 34:
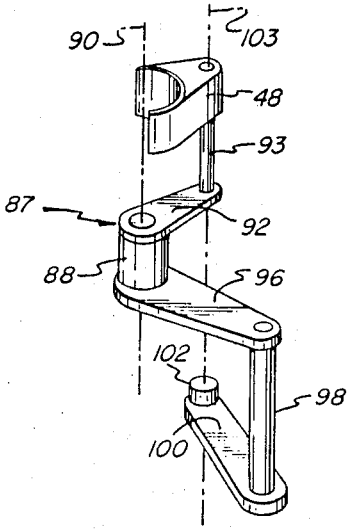
FIG. 34 is a perspective view of the feeder guide and its lever operating mechanism.

Rigidly mounted on the outer portion of the internal gear 78 is a plate 84 having a pin 86 extending upwardly therefrom and located on the pitch circle of the gear 78. Journalled on the pin 86 is a lever mechanism for the feeder guide 48 generally indicated by numeral 87 (FIG. 22) and including a bushing 88 rotatable about axis 90. As best seen in FIG. 34, the bushing 88 has an upper arm 92 extending outwardly therefrom with a support pin 93 mounted on the free end of the upper arm 92 and passing upwardly through an annular space 94 (see FIGS. 21 and 22) between the deck plate 40 and the annular turntable 46. The bushing 88 includes a lower arm 96 cantilevered outwardly therefrom at an acute angle relative to the upper arm 92. Extending downwardly from the outer end of the lower arm 96 is a rod 98 which is secured to one end of an extension arm 100. The other end of the extension arm 100 includes a cam roller or follower 102 captured in the circular cam track 75 to ride freely therein (see FIGS. 21 and 22). It should be noted that the cam roller 102 and the support pin 93 are always aligned on axis 103 while the feeder guide 48 and the pin 86 are axially aligned about axis 90. In this respect it should be noted that the feeder guide 48 extends transversely from the pin 93, the guide 48 having an arcuate concave shape at its distal end, as shown, for contact with a container to be placed; the axis 90 is coaxial with a central axis about which the concavely shaped distal end of the feeder guide 48 is formed. Although this concavely shaped distal end is shown as an arc of a circle, more precisely a segment of a cylinder, its shape may be varied depending upon the shape of the containers to be engaged and placed thereby. However, regardless of the precise shape of this concavely shaped distal end of guide 48, the central axis of the respective container when engaged and moved by the guide 48 is arranged to be coaxial with the axis 90.

Figure 35:
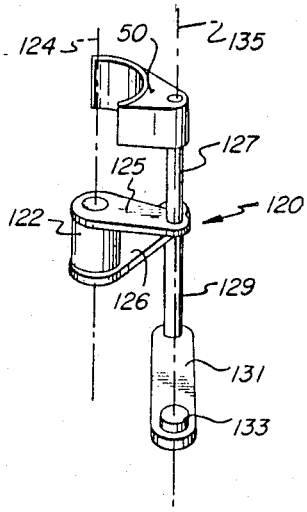
FIG. 35 is a perspective view of the discharge guide and its lever operating mechanism.

Referring to FIGS. 21, 22 and 35, the discharge guide 50 is operatively connected to a lever mechanism generally indicated by the numeral 120. The mechanism 120 is similar to the mechanism 87 for the feeder guide 48, but is mounted by its bushing 122 on a support pin 123 for rotation about axis 124. Arms 125 and 126 extend at an acute angle relative to one another from opposite ends of the bushing 122 and supportively mount pins 127 and 129, respectively, at the outer ends thereof. The pin 129 has an extension arm 131 on the lower end thereof which carries cam roller 133. The cam roller 133 is axially aligned with the pin 127 on axis 135 and is captured in the cam track 75. Again, the distal end of the discharge guide 50 is concavely shaped to conform to part of the shape of the container to be engaged thereby so that the central axis of the container is coaxial with the rotational axis 124.

Figures 29, 30, 31:
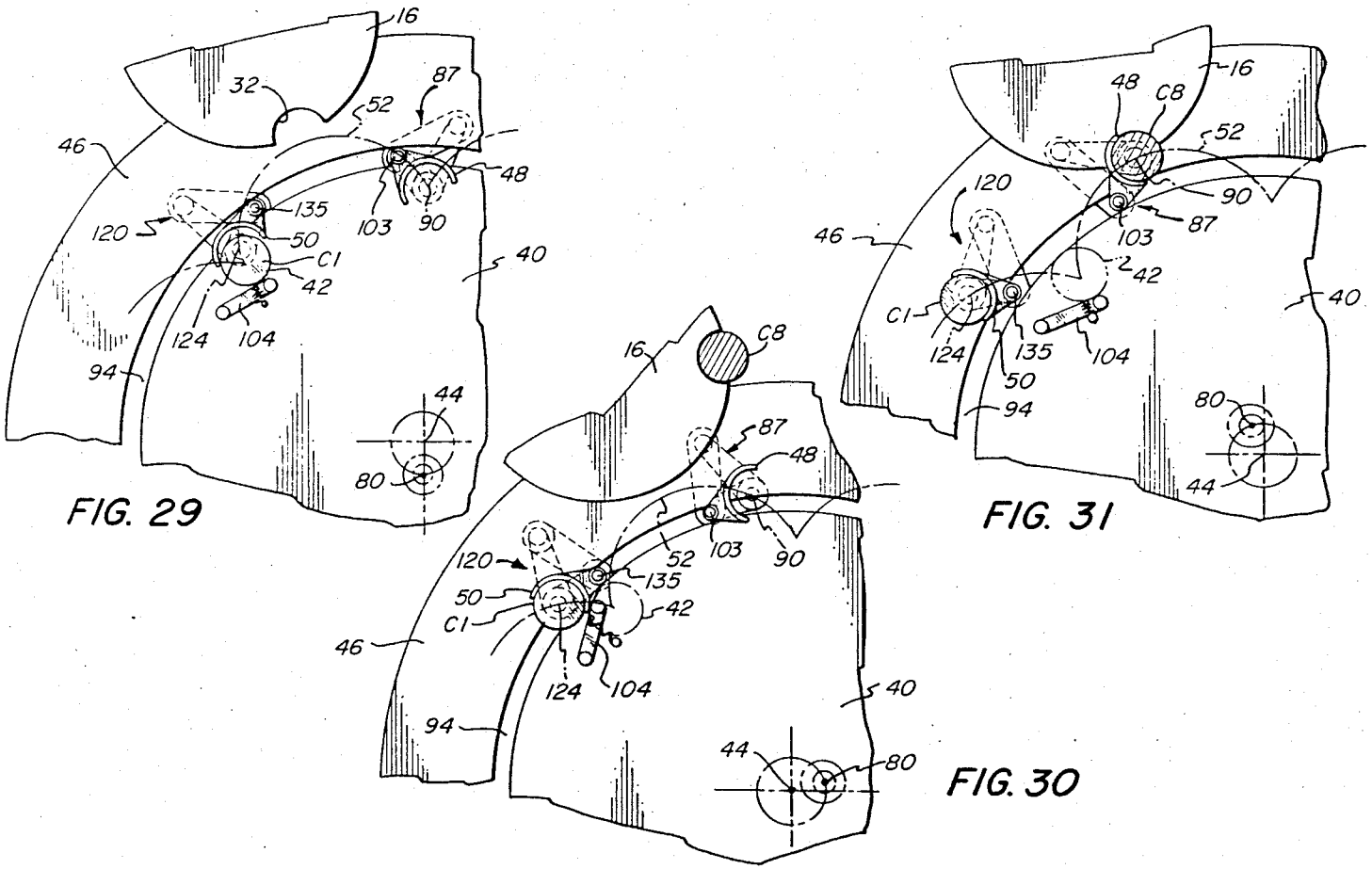
FIGS. 29 to 31 are schematic illustrations of the operation of a supply starwheel and the feeder and discharge guides.
Figure 32:
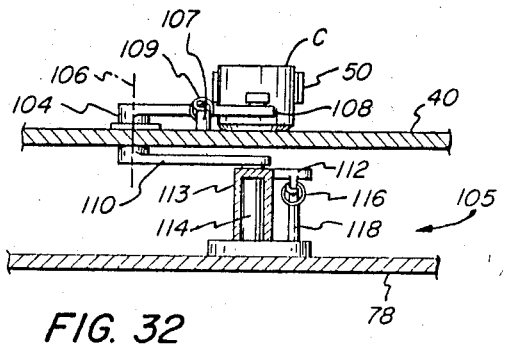
FIG. 32 is a fragmentary side elevational view of the apparatus of FIG. 1 with portions removed and broken away for clarity of illustration and showing the auxiliary discharge device cooperating with the discharge guide.

Referring now to FIGS. 29 to 31, in conjunction with FIGS. 34 and 35, axis 103 and thus pin 93 and cam roller 102 are on the leading or forward side of the axis 90 as the feeder guide moves in a counterclockwise direction in the epicycloidal path 52. The support pin 123 of the mechanism 120 is located forwardly of the axis 103 in the general direction of motion. The lever mechanism 120 is mounted in reverse of the mechanism 87 whereby the axis 135 trails the axis 124 as discharge guide 50 moves in the counterclockwise direction in the epicycloidal path 52.

Referring now to FIGS. 23 to 28 and 32, therein depicted is an auxiliary discharge device generally indicated by the numeral 105. The auxiliary discharge device 105 includes a plurality of container contact portions 104 located adjacent the receiving stations 42 (see FIG. 1). Each of the portions 104 is mounted for pivotal movement about an axis 106 in the stationary deck plate 40, and has an upper lever arm 108 biased into an inactive position against stop member 107 by a coil tension spring 109. A lower lever arm 110 is attached to the upper lever arm 108 at an acute angle thereto. As will be explained further hereinafter, the upper lever arm 108 of each of the container contact portions 104 contacts the associated container C while the lower lever arm 110 cooperates with an actuator 112 which is mounted on the internal gear 78 for movement therewith. The actuator 112 with bushing 113 is pivotally mounted on shaft 114 and biased by a coil tension spring 116 against the stop member 118 to the position shown in FIG. 23.

Figure 2:
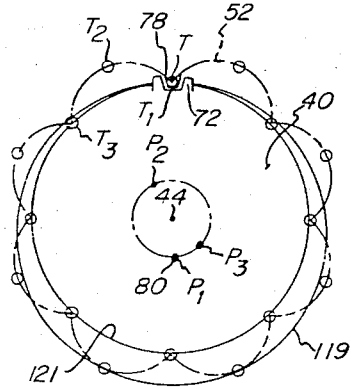
FIG. 2 is a diagrammatic illustration of the epicycloidal path described by a tooth T on an internal gear about a stationary gear.
Figure 3:
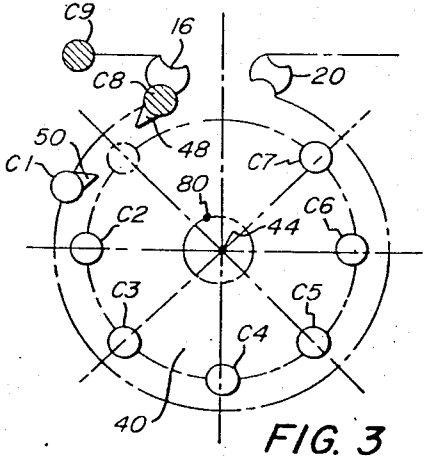
FIGS. 3 to 20 are schematic views illustrating the container placement apparatus and a method of the present invention performed thereby in operation with successive positions of a feeder guide and a discharge guide corresponding to successive turns to twenty-two and one-half degrees by the internal gear.
Figure 4:
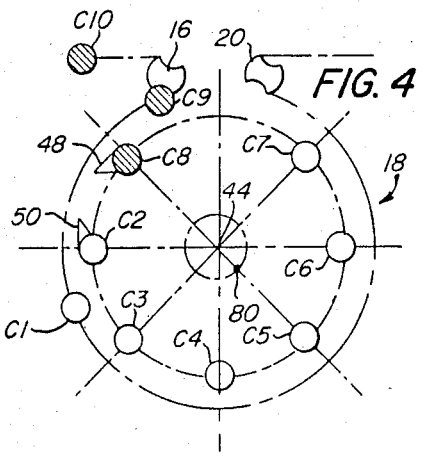
Figure 5:
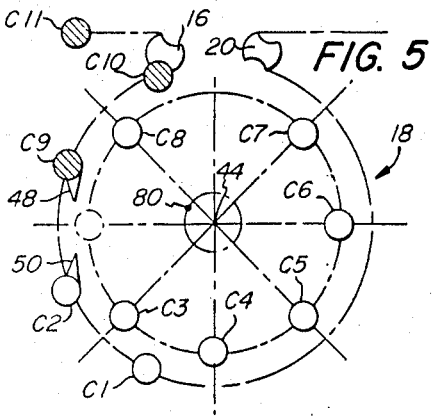
Figure 6:
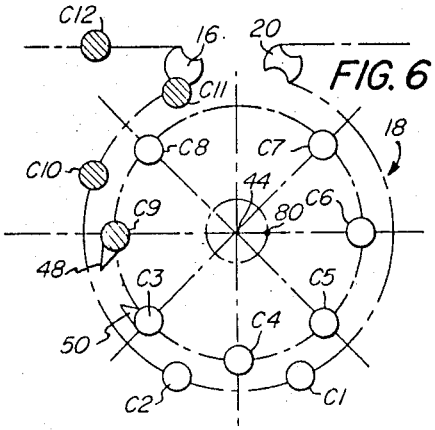
Figure 7:
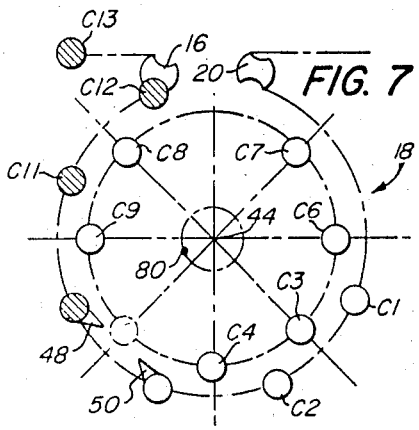
Figure 8:
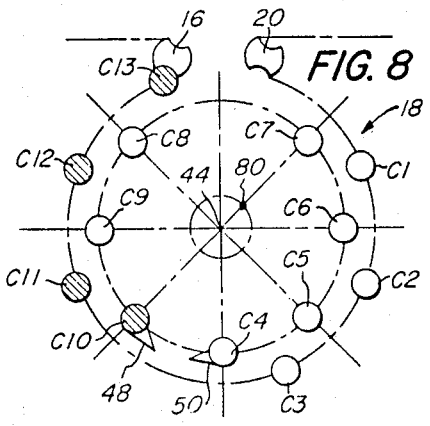
Figure 9:
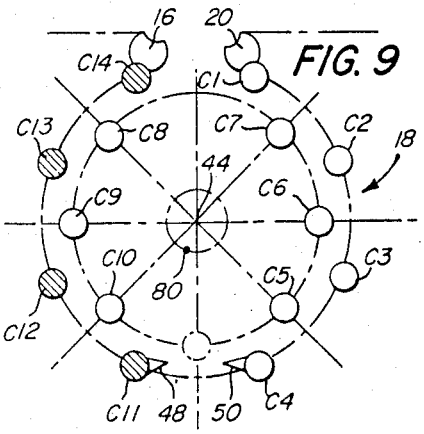
Figure 10:
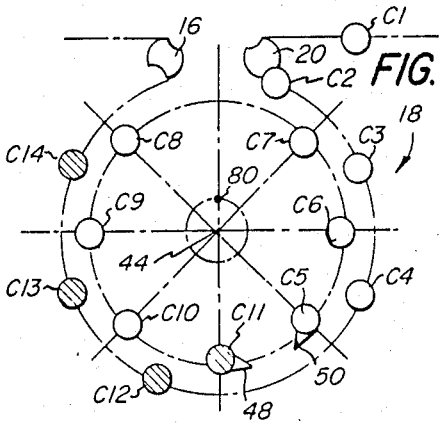
Figure 11:
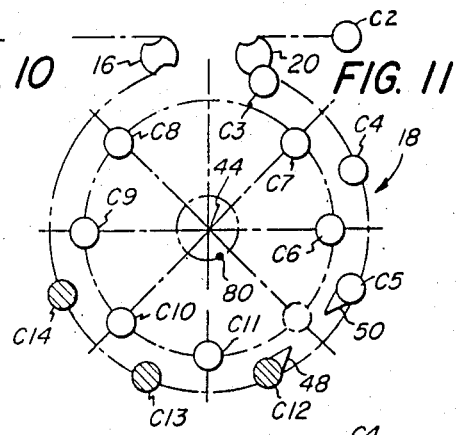
Figure 12:
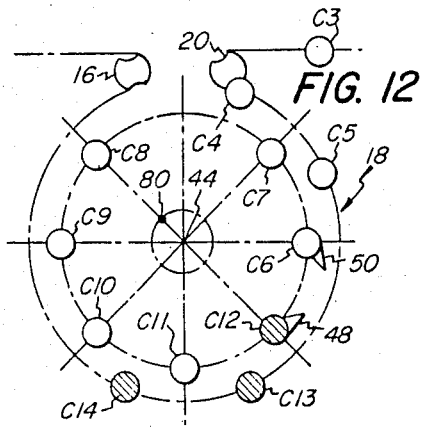
Figure 13:
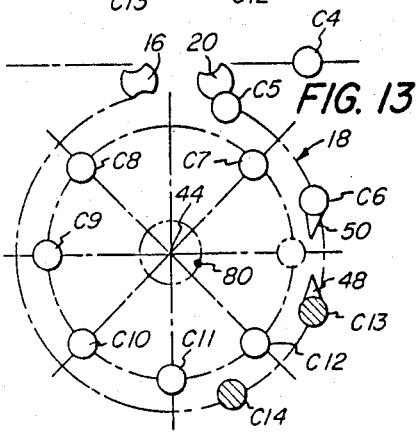
Figure 14:
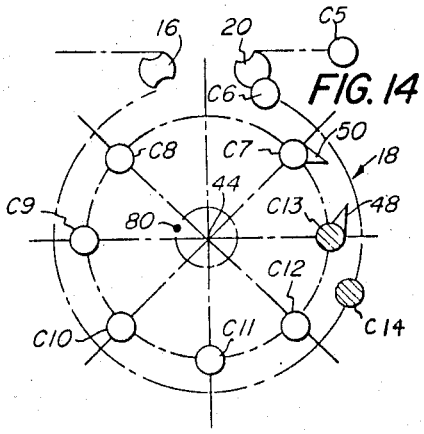
Figure 15:
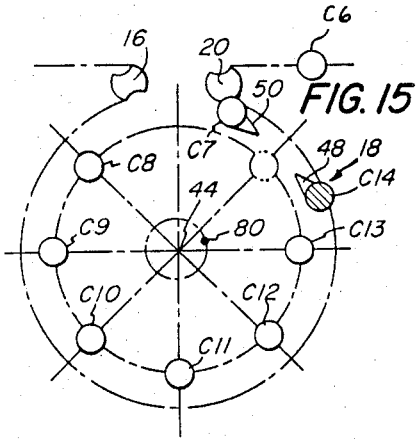
Figure 16:
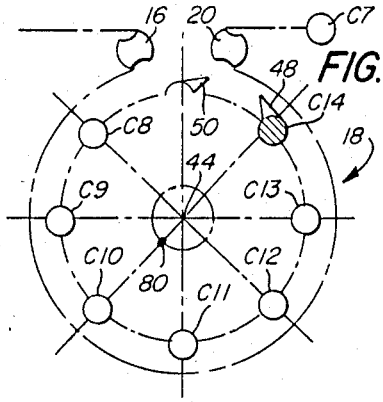
Figure 17:
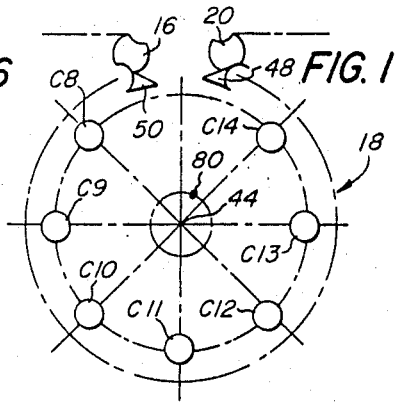
Figure 18:
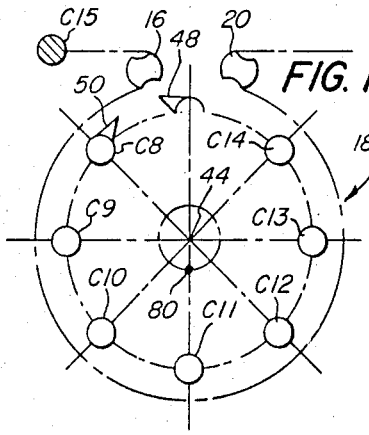
Figure 19:
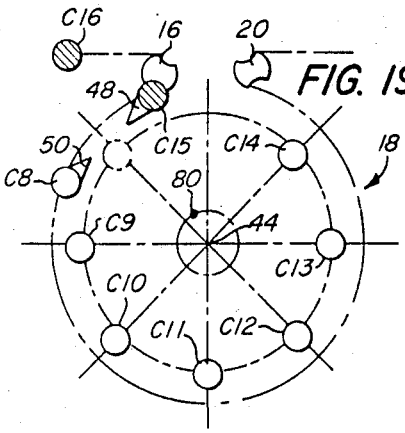
Figure 20:
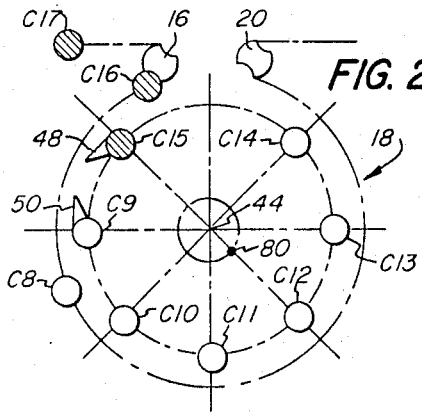

During normal operation of the machine starting from the machine position shown in FIGS. 1, 2 and 21, the main drive shaft 54 of the high speed placement apparatus 10 is rotated about central axis 44 thus swinging shaft 76 and internal gear 78 thereabout. Simultaneously, the gear train between the main drive shaft 54 and the drive plate 70 rotates the annular turntable 46 through column rods 71 at the desired angular speed. Meanwhile, the meshing relationship between the stationary gear 72 and internal gear 78 causes gear 78 to rotate about its axis 80. As illustrated in FIG. 2, the tooth T on the pitch circle 119 of internal gear 78 meshes with the teeth on the pitch circle 121 of stationary gear 72 at point T1 when the center 80 of the gear 78 is located at point P1. The tooth T at point T1 is momentarily stationary. As the axis 80 continues to rotate around central axis 44 at a constant speed in the counterclockwise direction toward point P2, internal gear 78 is forced to rotate around its own axis 80 in the counterclockwise direction, and tooth T accelerates in a counterclockwise direction toward point T2, which is furthest away from the central axis 44, along the epicycloidal path 52 between T1 and T3. The speed of the tooth T is at its maximum speed at point T2. Continued counterclockwise rotation of the center 80 past points P2 and P1 and finally to point P3, decelerates the tooth T along the path 52 between T2 and T3 back into meshing contact with the stationary gear 72 at T3. Continued rotation of the main drive shaft 54 causes the tooth T to describe identical curves along the outer periphery of the stationary gear 72. The resulting path 52 is a perfect epicycloidal curve.

In the illustrated embodiment, the diameter of the stationary gear 72 is twelve inches with one hundred twenty teeth and the diameter of the internal gear 78 is thirteen and one-half inches with one hundred thirty-five teeth. Therefore, the distance between axes 44 and 80 is three quarters of an inch.

In normal operation, internal gear 78 rotates through an angle of forty degrees around its own axis 80 for each complete revolution of the axis 80 around axis 44. This is computed as follows:

135 (number of teeth on gear 78) − 120 (number of teeth on gear 72) = 15 (difference) Difference/No. of teeth on gear 78 = 15/135 = 1/9 = 40/360

Therefore, axis 80 must make nine complete revolutions about axis 44 for internal gear 78 to make one complete revolution around gear 72.

The tooth T on internal gear 78 comes into contact with the stationary gear 72 once in every four hundred five degrees of the rotation of the axis 80 around axis 44. This is equal to one and one eighth turns around axis 44. Since a complete revolution of internal gear 78 requires nine turns of axis 80 around axis 44, the tooth T contacts with the stationary gear a total of eight times as shown in FIG. 2.

Referring again to FIGS. 20 to 31, the utilization of the epicycloidal motion of the internal gear 78 around the stationary gear 72 to oscillate the feeder guide 48 and discharge guide 50 can be more clearly understood. Referring first to the motion of the feeder guide 48, the axis 90 of pin 86 is located directly over the tooth T (see FIGS. 21 to 22) on the pitch circle of gear 78 and follows the epicycloidal path 52 illustrated in FIG. 2. As the pin 86 moves along the epicycloidal path 52, it forces the lever mechanism 87 to swing around the axis 90 since the cam roller 102 is captured in the cam track 75 and must follow the circular path defined thereby (see FIGS. 21 and 22). The angle over which the feeder guide 48 turns is determined by the arm length of upper arm 92 and in the embodiment herein depicted is ninety degrees so that the feeder guide 48 starts from a rest position adjacent the deck plate position between the starwheels 16 and 20 (FIG. 29) and swings outwardly (FIG. 30) in preparation to receive an empty container C8 from the starwheel 16 (FIG. 31) halfway between its travel to the receiving station 42.

Simultaneously with the movements performed by the feeder guide 48, the discharge guide 50, forwardly thereof, performs a similar movement. In the embodiment shown, the axis 124 of pin 123 of the discharge guide is positioned on the pitch circle of the internal gear 78 spaced fifteen teeth upstream from the tooth T. Since the lever mechanism 120 is mounted in reverse of lever mechanism 87, the discharge guide 50 swings around the axis 124 to enable the discharge guide to pick up a filled container from the stationary receiving station 42 (FIG. 29) and, with the assistance of the container contact portion 104 of the auxiliary discharge device 105, transfers the container radially outwardly (FIG. 30) onto the annular turntable 46 (FIG. 31) on which the container will continue to travel whilst the discharge guide 50 returns at a diminishing rate of speed to the next receiving station 42 to remove the associated filled container. It should be noted that the fifteen teeth spacing between the guides 48 and 50 causes the discharge guide 50 to lag slightly behind the feeder guide 48, e.g., the feeder guide 48 is in its stationary position in FIG. 29 while the discharge guide 50 is still approaching container C1 at weight station 42.

Figure 23:
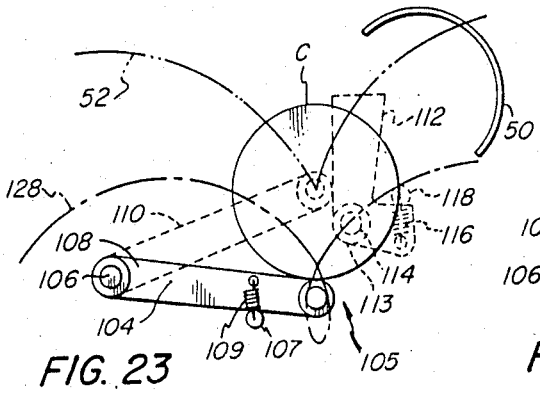
FIGS. 23 to 28 are schematic illustrations of the operation of an auxiliary discharge device in conjunction with the discharge guide.
Figure 24:
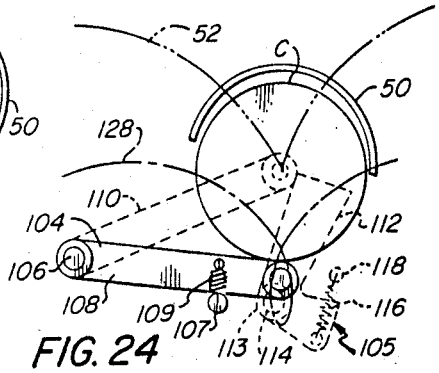
Figure 25:
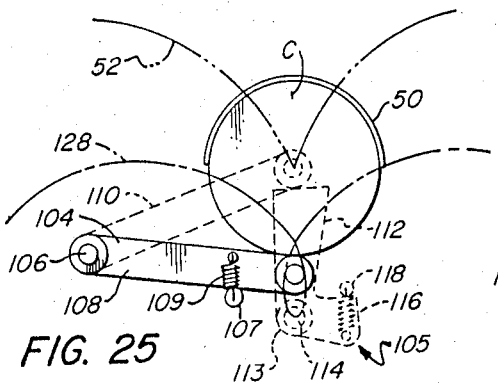
Figure 26:
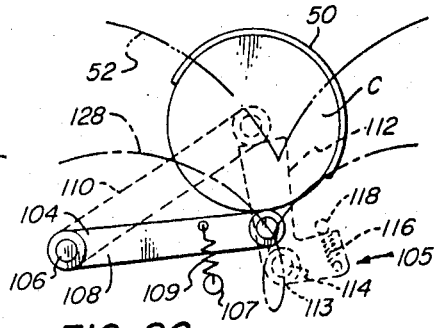
Figure 27:
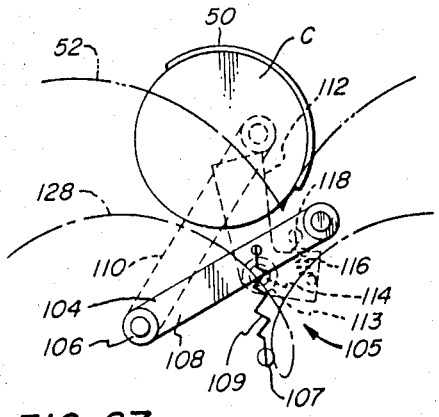
Figure 28:
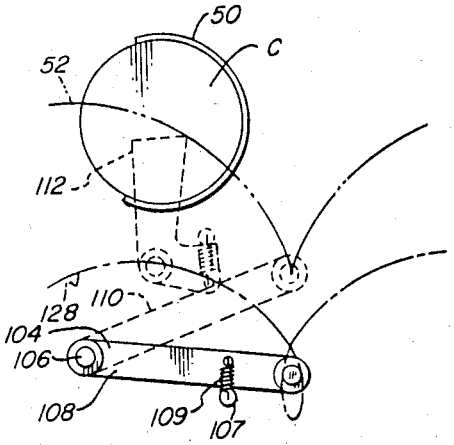

The operation of the auxiliary discharge device 105 is illustrated in FIGS. 23 to 28. Since points on the pitch circle of the gear 78 are describing epicycloidal curves, as its center axis 80 rotates around central axis 44, the pivot pin 114 spaced inwardly of the pitch circle on the gear 78 will traverse the curvilinear path indicated by numeral 128. In FIG. 23, the actuator 112 travelling with gear 78 initially engages the lower lever arm 110 of the container contact portion 104. Further movement of the gear 78 and the actuator 112 causes the actuator to pivot around the axis of the pivot pin 114 in the clockwise direction and against the bias of spring 116 (FIG. 24) until the actuator clears the lower arm 110 snapping back into the position shown in FIG. 25. The outer surface of the actuator 112 is then free to act upon the outer end of the lower lever arm 110 to enable the outer end of the upper lever arm 108 to cooperate with the discharge guide 50 and assist the transfer of the container C from the stationary receiving station 42 to the annular turntable 46 (FIGS. 26 and 30). As actuator 112 continues on the curvilinear path 128 as illustrated in FIGS. 27 and 28, the actuator 112 and the upper lever arm 108 disengage to allow the container contact portion 104 to return to original position under the influence of spring 109. It will be readily appreciated that the actuator 112 is mounted on the gear 78 adjacent discharge guide 50 and continues to follow the path 128. It performs its described function on each of the container contact portions 104 located adjacent each of the receiving stations 42 to cooperate with the discharge guide 50 in removing the containers therefrom.

Turning now to FIGS. 3 to 20 and again to FIG. 1, the high speed container placement apparatus 10 is diagrammatically illustrated in operation with the positions of the feeder guide 48 and discharge guide 50 shown in every turn of twenty-two and one-half degrees by gear 78 or, equivalently, a turn of two hundred two and one-half degrees of its axis 80 around axis 44.

As seen in FIG. 1, a group of seven containers C1 to C7 is in sequence in the placement device 18 with a respective one of the containers C1 to C7 located in each of the receiving stations 42. Meanwhile, a second group of seven containers C8 to C14 has been separated from the flooded delivery conveyor 12 by the clockwise rotation of the separating disk 24 utilizing seven cutouts 25. The rotation of the separating disk 24 is controlled by conventional means such as appropriate gearing to release groups of seven containers at the appropriate interval. The individual containers in the group C8 to C14 are spaced by the timing screw 26 and moved along arcuate surface 36 by the supply starwheel 16 onto the rotating annular turntable 46 where they can be intercepted by the feed guide 48.

As the containers are delivered to the receiving stations 42, an appropriate load cell (not shown) associated with each receiving station 42 measures the initial weight of the container and controls filling of the containers with a flow of product from the associated dispensing device 43 until the desired product weight has been reached. The load cells are conventional and commercially available and sold by Whitney Packaging-Processing Corporation located in Needham Heights, Mass. as their Model 0-8. The dispensing devices are commercially available from Mateer-Burt, a division of Berwind Corporation located in Wayne, Pa. and sold under the Trademark "Neotron Systems". For very accurate control, the dispensing of the product can be slowed to a very low rate as the desired net weight is reached.

As illustrated in FIGS. 3 to 20, the feeder guide 48 and discharge guide 50 act in concert by continuing to move around the periphery of the stationary deck plate 40 moving group C1 to C7 from the receiving stations 42 to the annular turntable 46 and replacing them with group C8 to C14. A third group of containers C15 to C21 (see FIG. 1) begins its approach to the container placement and removal device 18 in FIGS. 18 to 20.

As will be clearly apparent from studying the sequence of operations illustrated in FIGS. 3 through 20, the feeder guide 48 and the discharge guide 50 move around the central axis 44 together at the same rate, that is at the same r.p.m., with the discharge guide 50 always being a short distance downstream, that is ahead or forward, of the feeder guide 48. Also, it is clearly apparent that the annular turntable 46 rotates about the central axis 44 at a faster rate than the rate at which the guides 48, 50 move around the axis 44. This allows the unprocessed containers to successively advance towards the feeder guide 48 and then be intercepted and transferred by the feeder guide 48; it also allows for each processed container transferred back to the annular turntable by the discharge guide 50 to advance away from the discharge guide 50 leaving room for the next processed container to be transferred.

The speed of the annular turntable 46 and any containers thereon is at least equal to the speed of the feeder guide 48 at the moment the guide 48 intercepts a container on the turntable and to the speed of the discharge guide 50 at the moment the guide 50 releases a container on the turntable 46. Since the speed of each of the guides 48 and 50 at these moments is twice as fast as the average speed of gear 78, the annular turntable 46 has an angular speed at least twice as fast as the gear 78. With the illustrated arrangement, the turntable 46 rotates about the central axis 44 at a rate which is greater than twice the rate at which the guides 48, 50 are moved around the axis 44. The rate of rotation, i.e., r.p.m., of the turntable 46 may conveniently be in the range of 2.25 to 2.5 times the rate at which the guides 48, 50 are moved around the axis 44.

As will be appreciated, at the moment the feeder guide 48 fully intercepts a container to be placed, the container is then moving at twice the speed of the center of the rolling generating circle of the epicycloidal path, i.e. twice the rate at which the feeder guide 48 is being moved (or rotated) about the central axis 44. Then, at the instant the feeder guide 48 places this container at the respective receiving station 42, i.e. when at an inner cusp point of the epicycloidal path, the container and the feeder guide 48 are both at rest. In between, the container is smoothly decelerated at a changing rate of deceleration. The beginning and end portions of this deceleration have a lower rate, or value, than an intermediate portion of the deceleration. In other words, the rate of deceleration initially increases smoothly but rapidly from an initial rate, reaches a maximum rate of deceleration, and then the rate of deceleration decreases smoothly to a final rate. During this graduated deceleration the speed of the container smoothly decreases from twice the speed of the center of the rolling generating circle of the epicycloidal path to approximately 1.4 times the speed of the generating circle center at a point halfway to the rest position, and then over the second half of the epicycloidal path the container decreases from this 1.4 times speed to rest, i.e. to zero speed.

Similarly, the discharge guide 50 is momentarily at rest when it engages a stationary container at a respective receiving station 42. Then the discharge guide 50 and the container accelerate outwardly along the epicycloidal path until the discharge guide delivers the container to the turntable 46 at a speed which is twice that of the center of the rolling generating circle of the epicycloidal path. During this accelerating, the rate of accelerating rapidly increases from an initial rate, reaches a maximum rate of acceleration partway along the epicycloidal outward curved path, and then the rate of acceleration smoothly decreases to a final rate by the instant the discharge guide 50 releases the container. As the turntable 46 is moving at a greater speed than the maximum speed of the discharge guide at this point, the turntable effects a final accelerating of the processed container to the speed of the turntable. It will be noted that the processed container accelerates over the first half of this curved path from zero speed to a speed of approximately 1.4 times the speed of the center of the rolling generating circle of the epicycloidal path, and then over the second half of the curved epicycloidal path the container accelerates from this 1.4 times speed to twice the speed of the generating circle center.

In a modified construction, which is preferred for higher line speeds, the internally toothed gear 78 may be replaced by a much smaller externally toothed gear. Such externally toothed gear would have a diameter equal to the amplitude of each curved portion of the epicycloidal path, and would mesh with and roll around the periphery of the stationary gear 72. Referring to FIG. 2, the amplitude of the curved portions of the epicycloidal path 52 is the radial height of the point $T_2$ outwardly of the base circle constituted by the pitch circle 121 of the teeth of the stationary gear 72. This smaller externally toothed gear, on which would be eccentrically mounted the discharge guide mechanism 120, would comprise the generating circle of the epicycloidal path 52 as this gear rolled around the stationary gear 72. A second similar externally toothed gear would carry the feeder guide mechanism 87 and roll in mesh around the stationary gear 72 behind the discharge guide gear. The center of the rolling generating circle of the epicycloidal path, as referred to above, would be the center of the respective one of these smaller externally toothed gears.

As illustrated in FIGS. 9 to 15, the exit starwheel 20 is timed to intercept the processed or filled containers, as they move with the turntable 46, and swing them along arcuate surface 38 onto exit conveyor 22 for further processing and/or packaging.

With seven positions used for receiving stations 42 in the normally eight position container placement and removal device 18, and with the guides 48 and 50 on gear 78 separated by an angle of 45°, a container in any of the seven positions is replaced after the gear 78 makes one revolution around its axis 80 of exactly three hundred sixty degrees. Since the axis 80 rotates nine times around axis 44 to replace a container in the same position, the replacement period of a container is, in this example, one ninth of one revolution of gear 78 and the rest period thereof is eight ninths of the time for one revolution.

With an assumed line speed of two hundred containers per minute, gear 78 has to rotate 200/7=28.6 times per minute. Center 80 rotates nine times faster, that is at 257 RPM. The time required for one rotation is 60/257=0.233 seconds providing 1.86 seconds for each such rest period.

The relationship between the number of positions used on a unit 18, compared with the desired line speed, the resulting rest periods, etc. are as follows:

-continued

| | |
|---|---|
| Number of positions on unit | P |
| Number of positions used as receiving stations | P − 1 |
| Line speed (containers per minute) | LS |
| Gear ratio = gear 78/gear 72 = | $\frac{P+1}{P}$ |
| RPM of gear 78 = RPM G78 = | $\frac{LS}{P-1}$ |
| Time cycle for one revolution of gear 78 = 60/RPM G78 | $\frac{(P-1)\,60}{LS}$ |
| Time cycle for one revolution of axis 80 around axis 44 = | $\frac{60}{RPM\ G78 \times (P+1)}$ |
| Time cycle for one revolution of axis 80 around axis 44 = | $\frac{60 \times (P-1)}{LS \times (P+1)}$ |
| Rest period = number of positions on unit × time cycle for one revolution of gear 78 around gear 72 = | $\frac{P \times 60\,(P-1)}{LS\,(P+1)}$ |

The following charts list the rest period of containers with various sizes of units, based on different line speeds. As can be seen, relatively long rest periods can be obtained even on small units which operate at high line speeds. This will allow the time required for accurate dispensing of a product.

In the following charts, the letters at the top of the columns have the following meanings:

(a) Line speed, containers per minute
(b) RPM of gear 78
(c) Time cycle of gear 78 in seconds
(d) RPM of axis 80 around axis 44
(e) Time cycle of axis 80 around axis 44 in seconds
(f) Rest period in seconds With 8 positions on the unit there are 7 processing stations and the gear ratio of gear 78 to gear 72 is 9/8, and the following chart applies:

| (a) | (b) | (c) | (d) | (e) | (f) |
|---|---|---|---|---|---|
| 100 | 14.3 | 4.2 | 128.6 | 0.466 | 3.73 |
| 200 | 28.6 | 2.1 | 257.1 | 0.233 | 1.86 |
| 300 | 42.8 | 1.4 | 385.7 | 0.155 | 1.24 |
| 400 | 57.1 | 1.05 | 514.3 | 0.117 | 0.94 |
| 500 | 71.4 | 0.85 | 642.8 | 0.093 | 0.74 |
| 600 | 85.7 | 0.70 | 771.4 | 0.077 | 0.62 |

With 12 positions on the unit, 11 being processing stations, and the gear ratio of 78 to gear 72 being 13/12, the following chart applies:

| (a) | (b) | (c) | (d) | (e) | (f) |
|---|---|---|---|---|---|
| 100 | 9.1 | 6.6 | 118.2 | 0.507 | 6.08 |
| 200 | 18.2 | 3.3 | 236.4 | 0.254 | 3.04 |
| 300 | 27.2 | 2.2 | 354.5 | 0.169 | 2.03 |
| 400 | 36.4 | 1.6 | 472.7 | 0.127 | 1.52 |
| 500 | 45.5 | 1.3 | 591.0 | 0.101 | 1.22 |
| 600 | 54.5 | 1.1 | 709.0 | 0.085 | 1.02 |

With 18 positions on the unit, 17 being processing stations, and the gear ratio of gear 78 to gear 72 being 19/18, the following chart applies:

| (a) | (b) | (c) | (d) | (e) | (f) |
|---|---|---|---|---|---|
| 100 | 5.9 | 10.2 | 112 | 0.535 | 9.63 |
| 200 | 11.8 | 5.1 | 224 | 0.267 | 4.81 |

-continued

| (a) | (b) | (c) | (d) | (e) | (f) |
|---|---|---|---|---|---|
| 300 | 17.6 | 3.4 | 336 | 0.178 | 3.21 |
| 400 | 23.5 | 2.5 | 448 | 0.134 | 2.41 |
| 500 | 29.4 | 2.0 | 560 | 0.107 | 1.93 |
| 600 | 35.3 | 1.7 | 672 | 0.089 | 1.60 |

With 24 positions on the unit, 23 being processing stations, and the gear ratio of gear 78 to gear 72 being 25/24, the following chart applies:

| (a) | (b) | (c) | (d) | (e) | (f) |
|---|---|---|---|---|---|
| 100 | 4.3 | 14.0 | 107.5 | 0.56 | 13.4 |
| 200 | 8.7 | 7.0 | 215.0 | 0.28 | 6.7 |
| 300 | 13.0 | 4.6 | 322.5 | 0.18 | 4.5 |
| 400 | 17.4 | 3.5 | 430.0 | 0.44 | 3.3 |
| 500 | 21.7 | 2.8 | 537.5 | 0.11 | 2.7 |
| 600 | 26.0 | 2.3 | 645.0 | 0.09 | 2.2 |

The difference between the diameters of gears 72 and 78 is governed by the number of receiving stations or positions on the apparatus 10 and the diameter of the containers being processed. For example, an eight-position machine with a diameter for gear 72 of twenty-four inches and diameter for gear 78 of twenty-seven inches, can handle containers not larger than three inches in diameter, i.e., the difference in diameter between the gears. If it is necessary to handle containers of double the diameter, i.e. six inches in diameter, the diameters of gears 72 and 78, and the size of this entire machine will have to be doubled.

Another way to accommodate large-sized containers is to reduce the eight-position machine to four positions, without changing the diameter of the gear 72 but increasing that of gear 78 to thirty inches. However, such a machine will have a reduced capacity since it has only four positions. To overcome this lack of capacity, the four-position machine can be transformed into an eight-position machine without changing the diameters of gears 72 and 78 by rotating gear 72 on an intermittent basis in a direction opposite to the direction of gear 78. Gear 72 would have to be stationary whenever the guides 48 and 50 are in contact with containers in their stationary position. However, gear 72 can move as soon as the guides 48 and 50 start to move. The speed would be generally proportional to the speeds of the guides 48 and 50 on gear 78. Therefore, the four-position machine will essentially be changed to an eight-position machine capable of handling the same large containers without increasing the overall size by providing eight forty-five degree intermittent, backward movements of gear 72 totalling to a full turn, during the time required to turn axis 80 ten times around axis 44 and gear 78 one full turn, during which its guides will come to a stop eight times. These intermittent backward motions of gear 72 can be accomplished by conventional means such as an intermittently driven servo motor.

To change the same machine into a twelve-position machine, gear 72 will have to make twelve intermittent background movements of thirty degrees each, totalling to a full turn, while gear 78 makes one revolution with twelve stops and axis 80 rotates fifteen times around axis 44.

Figure 33:
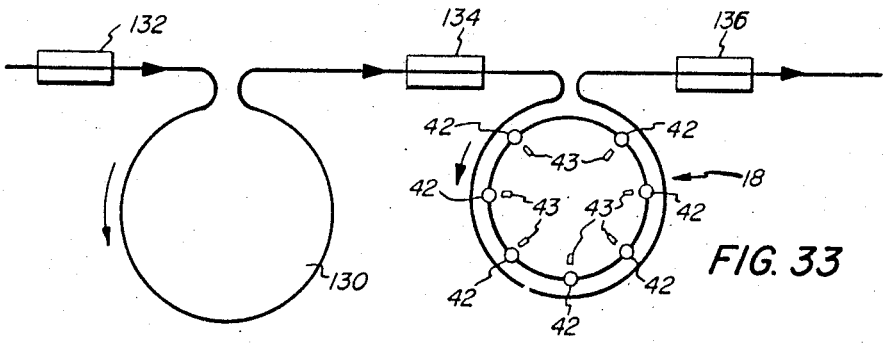
FIG. 33 is a schematic illustration of various arrangements of the apparatus of FIG. 1 to provide initial bulk filling of containers and subsequent high accuracy top-off filling of the containers.

To achieve the desired filling accuracy in the rest periods indicated on the preceding charts, it is sometimes desirable to bulk fill the containers prior to their introduction into the high speed container apparatus 10. FIG. 33 diagrammatically illustrates various arrangements to provide an initial bulk filling step to obtain maximum accuracy in product net weight. The filling device has a bulk filler generally indicated by numeral 130 and three positions 132, 134 and 136 for check weighers. Such weighers are commercially available from Whitney Packaging-Processing Corporation, Needham, Mass. and are sold under the trademark "Datachek". When the containers are non-uniform in weight, such as glass containers, the device can have a check weigher in position 132 and load cells at receiving stations 42. Each of the empty containers is weighed by the check weigher in position 132 and this information is relayed electronically to the load cell at receiving station 42 which will receive the same container and control the filling of the containers by weight. The empty containers are sent through the bulk filler 130 and filled by volume (to a little under weight) so that the containers merely have to be topped off with additional product at the receiving stations 42 by dispensing devices 43 to obtain the desired accurate net weight. This top-off operation is effective to reduce the filling time at receiving stations 42 and allows for very high speed operations.

Another arrangement is to replace the load cells of the previous example with a high speed check weigher at position 134. The partially filled containers coming from the bulk filler 130 are weighed by the check weigher in position 134 which relays the information to the respective dispensing devices to permit topping off of the partially filled containers.

Still another variation on this theme is the provision of another check weigher in position 136 to check the final net weight of the product as the containers leave the high speed placement device 18 of the previous example. The information generated by the check weigher in position 136 is used to automatically recalibrate the dispensing devices 43 on a continuous basis.

Thus, it can be seen from the foregoing detailed specification and attached drawings that the container placement method and apparatus of the present invention provide an effective way to smoothly decelerate a container from a high speed delivery conveyor, hold the container in a rest position for a predetermined amount of time, and smoothly accelerate the container back to high line speed.

It will be appreciated from the above that there is provided a novel container placement device for use in conjunction with filling devices which dispense product within very close tolerance of a desired weight. Such placement device decelerates the containers from high line speed to a stop for the filling operation, and afterwards accelerates them to the full line speed. Each container is automatically handled on an individual basis to insure accurate filling by weight thereof.

As will also be appreciated the illustrated container placement device may be readily fabricated and should enjoy a long life in operation.

It should be understood that the preferred embodiments have been described above for handling containers in a filling or dispensing apparatus. However, it will be appreciated that the present method and apparatus can be used to handle a variety of items or products and departures can be made by those skilled in the art without departing from the scope of the invention as defined in the appended claims.

For example, the invention could be used for filling containers or bottles with liquid. Also, the invention could be used for processing various types of containers, for example containers having a square-like cross-section such as some instant coffee jars, or bottle-like containers, etc. With non-circular cross-sectioned containers, the invention could advantageously be used in applying labels to the containers while stationary at the processing stations.

What is claimed is:

1. A high speed container placement apparatus, comprising:
   - a plurality of stationary container receiving stations disposed about a central axis;
   - a conveyor movable around said axis;
   - guiding means for guiding and transferring containers between said conveyor and said container receiving stations;
   - said guiding means comprising feeder and discharge guide members for moving the containers respectively to and from the receiving stations; and
   - means for moving each of said guide members around said axis and for causing each of said guide members to define an epicycloidal type path, said guide members moving the containers to and from the receiving stations along portions of the epicycloidal type path.

2. The apparatus of claim 1, comprising:
   - means for moving said conveyor around said axis; and
   - means for interrelating said conveyor moving means and said guide members moving means to cause said conveyor to move around said axis faster than said guide members move around said axis.

3. The apparatus of claim 2, wherein said interrelating means comprises gearing which effects moving of said conveyor around said axis at least twice as fast as said guide members are moved around said axis.

4. The apparatus of claim 1, wherein said discharge guide member is located ahead of said feeder guide member, said receiving stations comprise container processing stations, the feeder guide member placing at a respective one of said receiving stations a container to be processed at that receiving station after the discharge guide member has removed from that receiving station a container that has been processed there, and said conveyor comprises a turntable rotatable about said axis.

5. The apparatus of claim 1, further comprising means for oscillating said guide members as said guide members move around said central axis.

6. The apparatus of claim 1, wherein each of said guide members is pivotally mounted eccentrically on a rotatable gear.

7. The apparatus of claim 6, wherein said rotatable gear meshes with and rotates around a stationary gear, said stationary gear being coaxial with said axis.

8. The apparatus of claim 6, wherein said gear forms part of gearing through which movement of said conveyor and movement of at least one of said guide members around said axis are interrelated.

9. The apparatus of claim 1, further comprising means for separating a supply of containers into groups of containers, for separating the containers within a group, and for sequentially introducing each group of containers onto said conveyor.

10. The apparatus of claim 1, further comprising an auxiliary discharge device to assist said discharge guide member in moving said containers from said receiving stations to said conveyor.

11. The apparatus of claim 1, wherein said container receiving stations comprise weigh stations with product dispensing devices for dispensing product by weight into said containers.

12. A method of high speed placement of containers, comprising the steps of:
   - introducing a container into a circular path at a first speed;
   - transporting said container along said circular path at said first speed;
   - transferring said container along a epicycloidal path to a stationary rest position;
   - maintaining said container in said rest position for a rest period;
   - processing said container during said rest period;
   - transferring said container along said epicycloidal path from said rest position to said circular path;
   - moving said container along said circular path at said first speed; and
   - removing said container from said circular path at said first speed.

13. The method of claim 12, wherein said step of transferring said container to said stationary rest position includes the steps of intercepting said container in said circular path and decelerating said container along said epicycloidal path, and said step of transferring said container from said rest position to said circular path includes the step of accelerating said container along said epicycloidal path.

14. The method of claim 12, wherein said processing step comprises dispensing contents by weight into said container.

15. A method of high speed placement of workpieces such as containers, comprising the steps of:
   - providing a plurality of workpiece receiving stations spaced equidistantly from a central axis;
   - providing a group of workpieces;
   - introducing said workpieces into a circular path at a first speed, moving said workpieces at said first speed along said circular path after their introduction;
   - transferring said workpieces from said circular path to said workpiece receiving stations by means of an oscillating feeder guide, each individual workpiece of said group being transferred sequentially to a selected one of said workpiece receiving stations;
   - maintaining each of said workpieces at its selected one of said workpiece receiving stations for a rest period;
   - sequentially transferring each of said workpieces from its selected one of said workpiece receiving stations to said circular path by means of an oscillating discharge guide; and
   - moving each of said workpieces along said circular path following its transfer thereto.

16. The method of claim 15, wherein said oscillating feeder and discharge guides follow an epicycloidal path around said central axis and said discharge guide moves ahead of said feeder guide.

17. The method of claim 15, wherein said workpieces are containers, and said processing step comprises a product dispensing step of filling said containers by weight.

18. The method of claim 15, wherein said step of transferring said workpieces with said oscillating discharge guide includes utilizing an auxiliary discharge device to assist said discharge guide in moving said workpieces from said receiving stations to said circular path.

19. A method of high speed placement of containers, comprising the steps of:

moving a container along a selected path at a production line speed;

intercepting said container;

decelerating the intercepted container to rest;

said intercepted container being moved along a first curved path during said decelerating step and being transferred thereby to a stationary container receiving station;

processing said container while at rest at said container receiving station;

returning the processed container to said selected path;

accelerating said processed container along a second curved path during said returning step; and continuing said container along said selected path at said production line speed.

20. The method of claim 19, wherein said selected path comprises a circular path around said container receiving station, and said first and second curved paths are portions of an epicycloidal path.

21. The method of claim 20, wherein said decelerating and accelerating steps are performed by a feeder guide member and a discharge guide member, respectively, and including the step of moving said guide members around said container receiving station at a rate slower than said producton line speed.

22. The method of claim 19, wherein:

said selected path extends around said container receiving station, and said decelerating and accelerating steps are performed by feeder guide and discharge guide members, respectively; and including the steps of:

moving said guide members around said container receiving station at a rate no more than half said production line speed.

23. The method of claim 21, comprising the steps of introducing a series of the containers to said circular path in spaced apart relationship, sequentially transferring said containers one at a time with said feeder guide member to a plurality of stationary container receiving stations inside said circular path, and sequentially removing processed containers one at a time with said discharge guide member from said container receiving stations, each processed container being so removed just prior to said feeder guide member transferring a container to the respective container receiving station.

24. The method of claim 19, including the step of:

partially pre-filling the container with contents before said intercepting step; and wherein said processing step comprises dispensing by weight further contents to fill said container to a predetermined net weight.

25. The method of claim 24, wherein said partially prefilling step comprises dispensing the contents by volume, and said processing step includes weighing.

26. The method of claim 19, wherein said decelerating and said accelerating both smoothly change in rate along said first and second curved paths.

27. The method of claim 19, wherein said accelerating is graduated in rate, a portion of said accelerating along an intermediate portion of said second curved path being at a higher rate than said accelerating along beginning and end portions of said second curved path.

28. The me;thod of claim 19, wherein said decelerating is graduated in rate, a portion of said decelerating along an intermediate portion of said first curved path being at a higher rate than said decelerating along first and last portions of said first curved path.

29. The method of claim 19, wherein said first and second curved paths comprise portions of a curve generated by a point on the circumference of a circle rolling on a base path.

30. The method of claim 29, wherein said base path is a circle.

* * * * *